US008599041B2

(12) United States Patent
Lim et al.

(10) Patent No.: US 8,599,041 B2
(45) Date of Patent: Dec. 3, 2013

(54) APPARATUS AND METHOD FOR CONTROLLING TRAFFIC LIGHT

(75) Inventors: Hyoungsoo Lim, Daejeon (KR); So-Ra Park, Daejeon (KR); Heung-Mook Kim, Daejeon (KR); Soo-In Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 407 days.

(21) Appl. No.: 12/633,874

(22) Filed: Dec. 9, 2009

(65) Prior Publication Data

US 2010/0141477 A1 Jun. 10, 2010

(30) Foreign Application Priority Data

Dec. 9, 2008 (KR) ..... 10-2008-0124630
Nov. 30, 2009 (KR) ..... 10-2009-0116757

(51) Int. Cl.
*G08G 1/07* (2006.01)

(52) U.S. Cl.
USPC ..... 340/906; 340/901; 340/902; 340/904

(58) Field of Classification Search
USPC ..... 340/906
See application file for complete search history.

(56) References Cited

U.S. PATENT DOCUMENTS 4,135,144 A * 1/1979 Elmasian ..... 340/906
6,441,749 B1 * 8/2002 Edwards ..... 340/902
2003/0128135 A1 * 7/2003 Poltorak ..... 340/906
2004/0196162 A1 * 10/2004 Brooke ..... 340/906
2005/0128103 A1 * 6/2005 Bachelder ..... 340/906
2010/0045484 A1 * 2/2010 Brynielsson ..... 340/906
2010/0321577 A1 12/2010 Park et al.

FOREIGN PATENT DOCUMENTS

JP 06-301886 A 10/1994
JP 2004-252854 A 9/2004
KR 1996-0006035 2/1996
KR 1020010017337 A 3/2001
KR 10-0470448 B1 1/2005
KR 1020050058662 A 6/2005
KR 1020060069153 A 6/2006
KR 1020060083357 A 7/2006
KR 1020060107262 A 10/2006
KR 1020070006099 A 1/2007
KR 1020080016963 A 2/2008
KR 1020080051446 A 6/2008

* cited by examiner

*Primary Examiner* — Kerri McNally
(74) *Attorney, Agent, or Firm* — Ladas & Parry LLP

(57) ABSTRACT

A traffic light control apparatus and method is provided. The traffic light control apparatus for controlling an emergency vehicle in a traffic network includes: a traffic network control unit configured to determine overall traffic network control and traffic light control for supporting movement of the emergency vehicle during an emergency and transmit a control signal; a traffic light control unit configured to receive the control signal to control a traffic light; and an emergency vehicle control unit configured to transmits a traffic light control mode cancellation request signal to the controlled traffic light.

12 Claims, 21 Drawing Sheets

APPARATUS AND METHOD FOR CONTROLLING TRAFFIC LIGHT

CROSS-REFERENCE(S) TO RELATED APPLICATIONS

The present application claims priority of Korean Patent Application Nos. 10-2008-0124630 and 10-2009-0116757, filed on Dec. 9, 2008, and Nov. 30, 2009, respectively, which are incorporated herein by reference in their entirety.

BACKGROUND OF THE INVENTION

1. Field of the Invention

Exemplary embodiments of the present invention relates to an apparatus and method for controlling a traffic light; and, more particularly, to a traffic light control apparatus and method for supporting an emergency vehicle in an emergency.

2. Description of Related Art

A desire to facilitate the movement of human beings has become a motive power to invent and develop faster and more stable vehicles from primitive means to the most advanced airplane. Among the vehicles, the most familiar and popularized vehicle is a car. As the number of cars rapidly increases, controlling cars in a crowded intersection or the like has become necessary. Furthermore, a traffic system has been designed to protect human beings from cars. Such a traffic system has developed into a nationwide network based on traffic lights. To maintain such a traffic system, much research is being conducted on various apparatuses and methods.

In a recent traffic network, one control station may cover a wide area through various types of monitoring devices and control devices for smooth traffic flow. However, when the transportation of firemen, medical workers, policemen, or soldiers and equipments is required because of a sudden fire or accident, there are few efficient solutions. In particular, when a fire truck, an ambulance, or a police car travels in an emergency, the traveling inevitably relies on spontaneous cooperation of other vehicle drivers. In the crowded downtown area, even the cooperation is impossible. As a result, an opportunity of solving an accident in an early stage may be missed.

To solve such a problem, one central control station may control traffic lights to secure a moving path of an emergency vehicle. Hereafter, a method of securing a moving path of an emergency vehicle will be described with reference to accompanying drawings.

FIG. 1 is a configuration diagram of a traffic light control method in an emergency, illustrating a case in which there is no median strip.

In FIG. 1, it is assumed that an emergency vehicle 110 enters from the north to travel to one of the east, the west, and the south. When an emergency occurs, all traffic lights 161, 162, 163, and 164 in an intersection are set to display a red light, that is, a stop signal. Then, the emergency vehicle 110 takes an opposite lane of its traveling direction to enter into the intersection, and passes through the intersection.

FIG. 2 is a configuration diagram of a traffic light control method in an emergency, illustrating a case in which there is a median strip. In FIG. 2, it is assumed that an emergency vehicle 210 enters from the north to travel to one of the east, the west, and the south. FIG. 2 shows the same situation as that of FIG. 1. In FIG. 2, however, since the median strip exists, the emergency vehicle cannot take an opposite lane of its traveling direction. In FIG. 2, two other vehicles 221 and 222 block the way of the emergency vehicle. Therefore, only after the vehicles 221 and 222 pass through the intersection, the emergency vehicle can pass through the intersection. To pass the vehicles 221 and 222, east and west traffic lights 263 and 261 are set to display a red light, and a south traffic light 262 is set to display a green light and a left-turn light. More specifically, the east and west traffic lights 263 and 261 are set to display a red light such that vehicles 231 and 232 traveling from the west and vehicles 251 and 252 traveling from the east are prevented from entering into the intersection. Furthermore, the south traffic light 262 is set to display a green light and a left-turn light such that the emergency vehicle 210 may go straight or make a left or right turn after the vehicles 221 and 222 traveling from the north passes through the intersection. Then, the emergency vehicle can pass through the intersection.

However, when the central control station controls the respective traffic lights depending on the traveling state of the emergency vehicle, huge human and material costs are required in the downtown where accidents occur frequently. Furthermore, when the precision of traffic signal control is decreased to reduce such costs, it may cause unnecessary inconveniences in traveling of vehicles. Accordingly, a signal system which can be properly controlled in an emergency is required.

SUMMARY OF THE INVENTION

An embodiment of the present invention is directed to a traffic light control apparatus and method capable of effectively securing a path when an emergency vehicle passes.

Another embodiment of the present invention is directed to a traffic light control apparatus and method capable of minimizing an effect upon traveling of other vehicles, when an emergency vehicle passes.

Another embodiment of the present invention is directed to a traffic light control apparatus and method which may be applied to a generalized broadcasting communication network.

Another embodiment of the present invention is directed to a traffic light control apparatus and method which may be easily implemented.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a traffic light control apparatus for controlling an emergency vehicle in a traffic network includes: a traffic network control unit configured to determine overall traffic network control and traffic light control for supporting movement of the emergency vehicle during an emergency and transmit a control signal; a traffic light control unit configured to receive the control signal to control a traffic light; and an emergency vehicle control unit configured to transmits a traffic light control mode cancellation request signal to the controlled traffic light.

In accordance with another embodiment of the present invention, a traffic light control method of a traffic light control unit for controlling a traffic light to pass an emergency vehicle in a traffic network includes: setting the traffic light such that the emergency vehicle passes, when a first control signal for passing the emergency vehicle is received from a central control station; maintaining the setting of the traffic light for a predetermined time after the traffic light is set; and controlling the traffic light through a predetermined scheme, when a cancellation signal is received from the emergency vehicle after the traffic light is set.

In accordance with another embodiment of the present invention, a traffic light control method of an emergency vehicle to control a traffic light in a traffic network includes: receiving a traffic light control signal and a traffic light identifier (ID) signal from a traffic light control unit; determining whether the emergency vehicle passed the traffic light or not by using the traffic light control signal and the traffic light ID signal; and generating and transmitting a signal for cancelling a control mode when the emergency vehicle passed the traffic light.

DESCRIPTION OF SPECIFIC EMBODIMENTS

Figure 1:
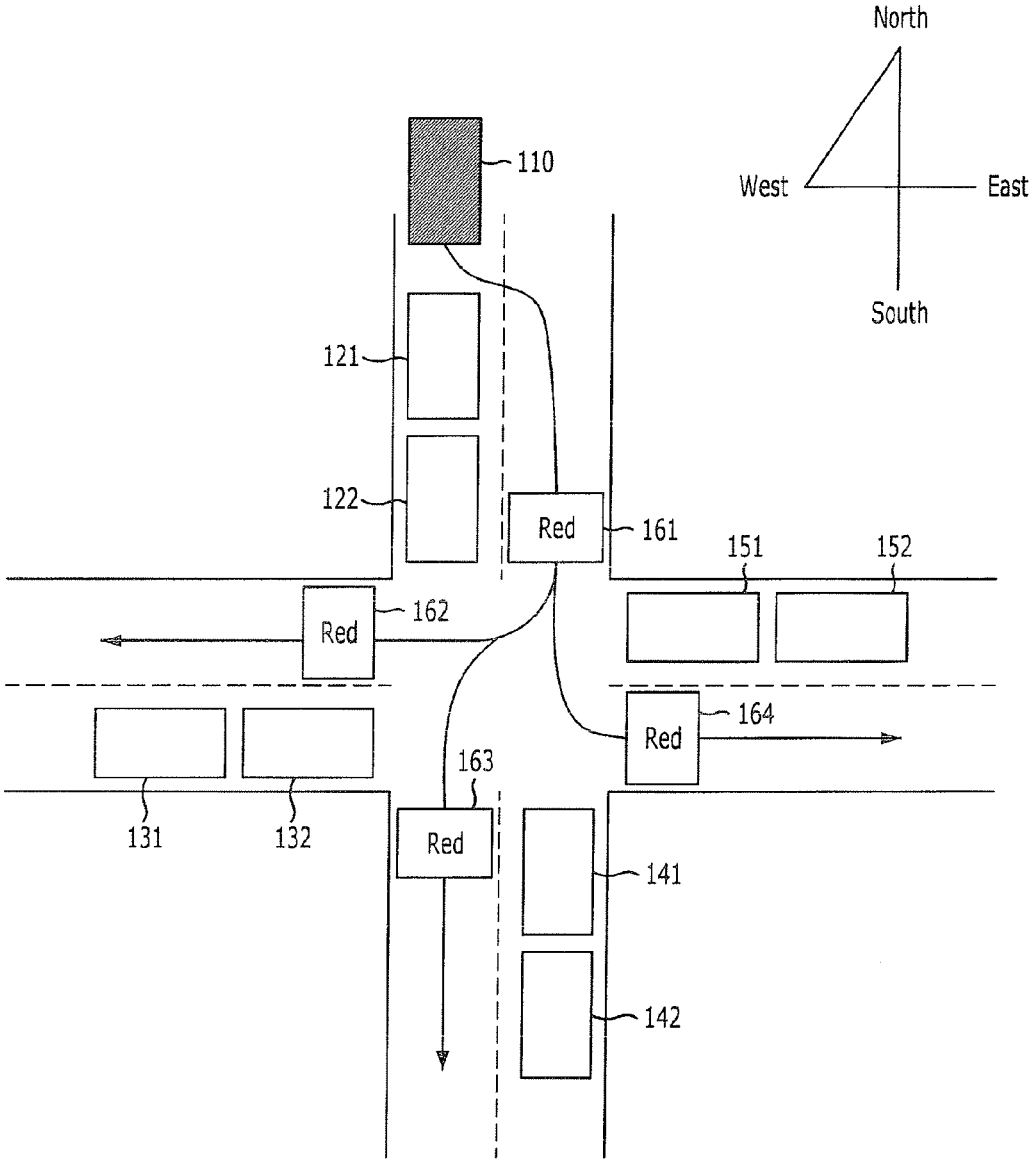
FIG. 1 is a configuration diagram of a traffic light control method in an emergency, illustrating a case in which there is no median strip.
Figure 2:
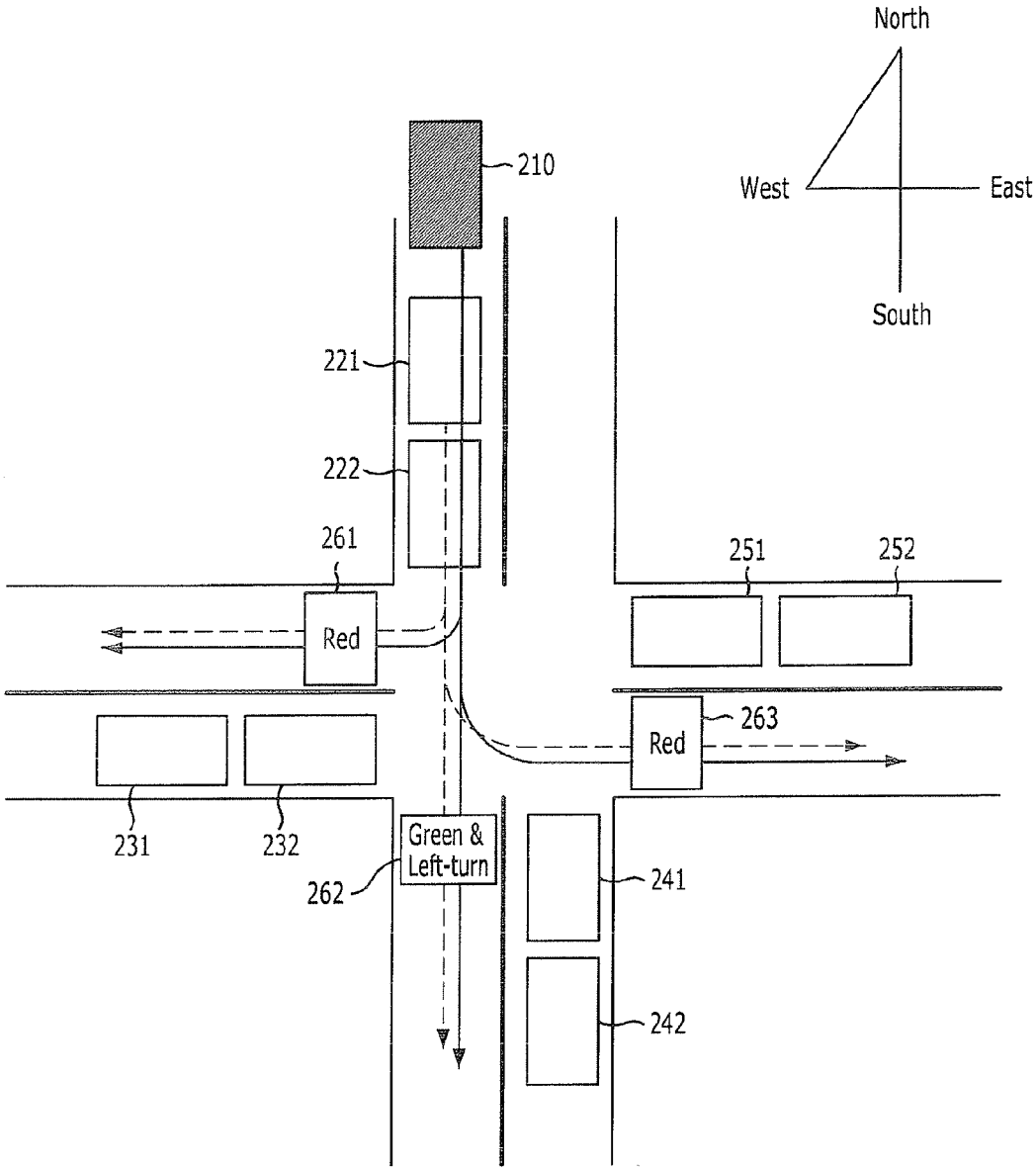
FIG. 2 is a configuration diagram of another traffic light control method in an emergency, illustrating a case in which there is a median strip.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

Figure 3:
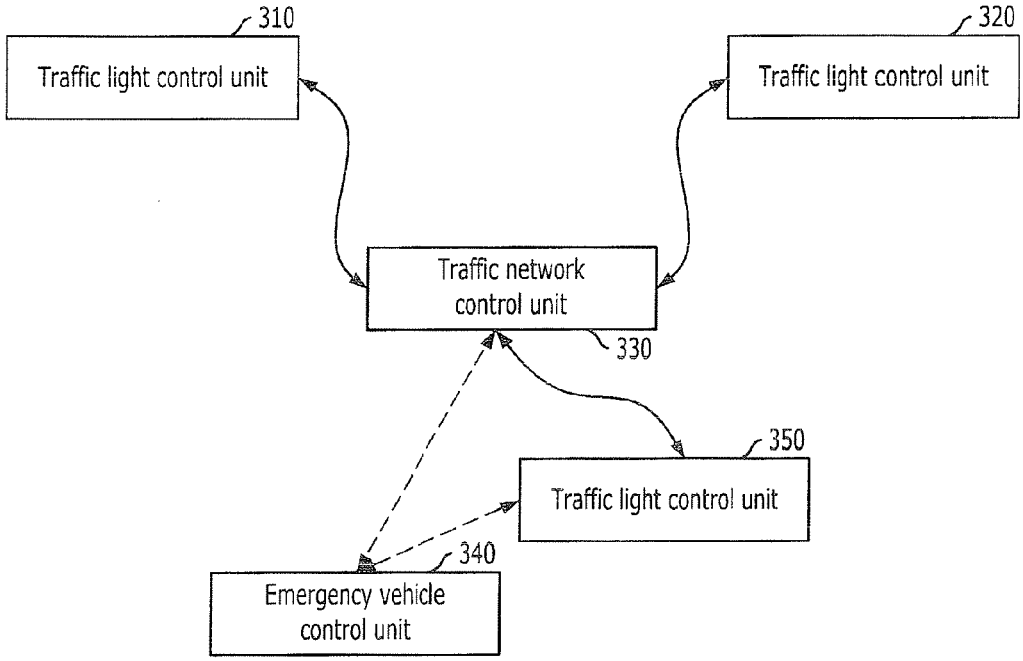
FIG. 3 is a configuration diagram of a traffic light control network in accordance with embodiments of the present invention.

FIG. 3 is a configuration diagram of a traffic light control network in accordance with embodiments of the present invention.

In FIG. 3, the traffic light control network includes signal control units 310, 320, and 350, a traffic network control unit 330, and an emergency vehicle control unit 340, in order to control traffic lights and transmit an emergency signal. Referring to FIG. 3, an operation of a traffic light control apparatus in accordance with an embodiment of the present invention will be described. The traffic network control unit 330 generates a traffic light control signal including traffic light identifiers (ID) corresponding to traffic lights positioned on a moving path of an emergency vehicle depending on emergency occurrence information which is transmitted to a prevention center, and then transmits the generated traffic light control signal to all the traffic light control units 310, 320, and 350. The traffic light control units 310, 320, and 350 receive the control signal from the traffic network control unit 330. Among the traffic light control units 310, 320, and 350, all or some of them may be positioned on the moving path of the emergency vehicle. In this case, the traffic light control units positioned on the moving path may control corresponding traffic lights and transmit information to the emergency vehicle control unit 340 of the emergency vehicle. Furthermore, when determining that the emergency ended or when receiving a control completion signal of the emergency vehicle, the traffic light control units positioned on the moving path of the emergency vehicle may cancel the control mode, and transmit the information to the traffic network control unit 330. The emergency vehicle control unit 340 may receive a control signal from the traffic network control unit 330 or the traffic light control unit 350 or a Global Positioning System (GPS) signal. The emergency vehicle control unit 340 may generate a control cancellation request signal. When receiving a control cancellation response signal from the traffic light control unit, the emergency vehicle control unit 340 may transmit a cancelation completion signal to the traffic network control unit 330.

Figure 4:
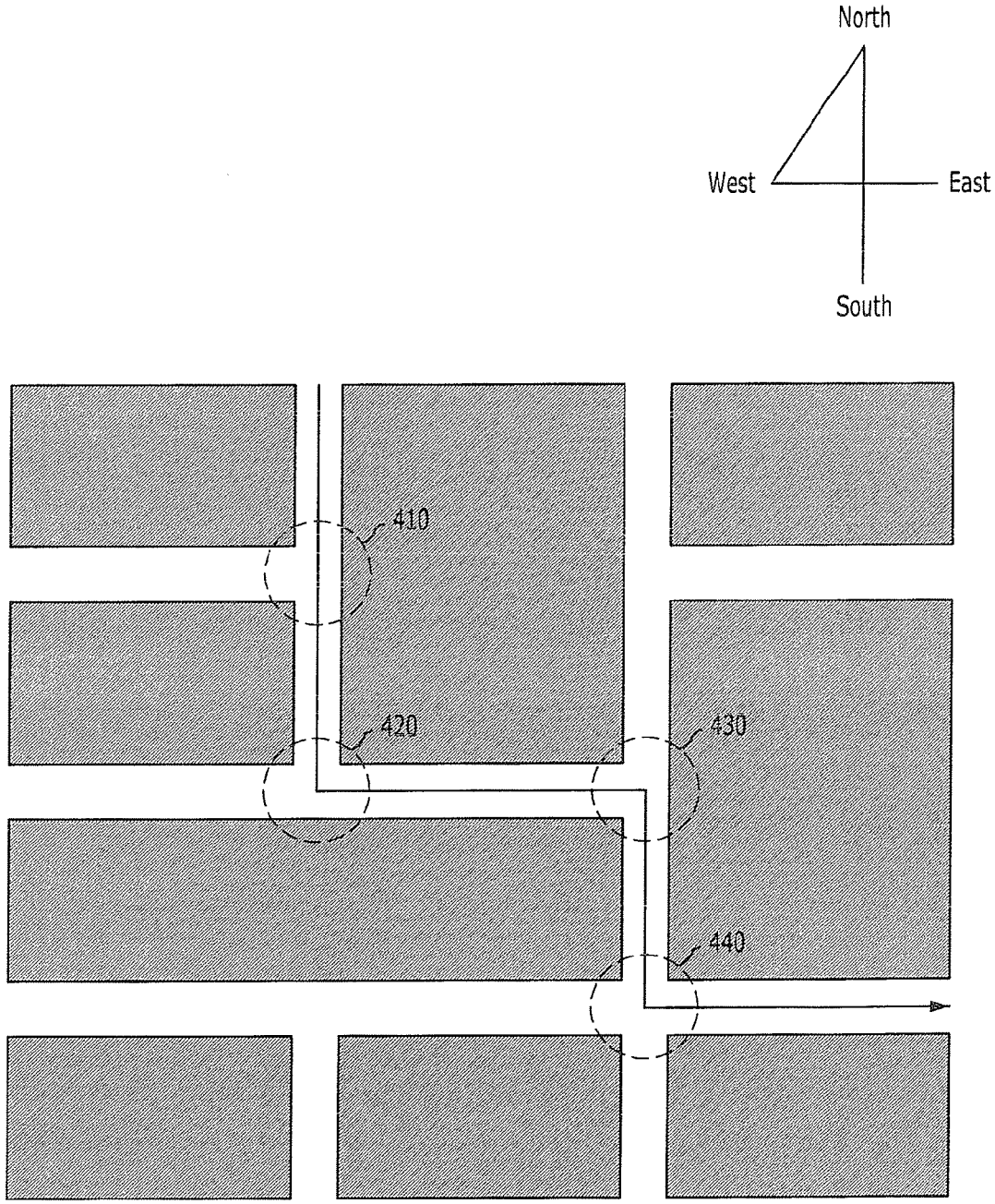
FIG. 4 is a diagram illustrating traffic-light control target positions on a moving path of an emergency vehicle.

FIG. 4 is a diagram illustrating traffic-light control target positions on a moving path of an emergency vehicle.

In FIG. 4, it is assumed that the emergency vehicle enters from the north and sequentially passes through four intersections 410 to 440. In the intersection 410, the left-turn direction of vehicles entering from the west may be controlled to pass the emergency vehicle. In the intersection 420, the straight and left-turn directions of vehicles entering from the west may be controlled to pass the emergency vehicle. In the intersection 430, the straight direction of vehicles entering from the north may be controlled to pass the emergency vehicle. In the intersection 440, all directions may be controlled, or the left-turn and straight directions of vehicles entering from the south and the west and the straight direction of vehicles entering from the east may be controlled to pass the emergency vehicle.

Figure 5:
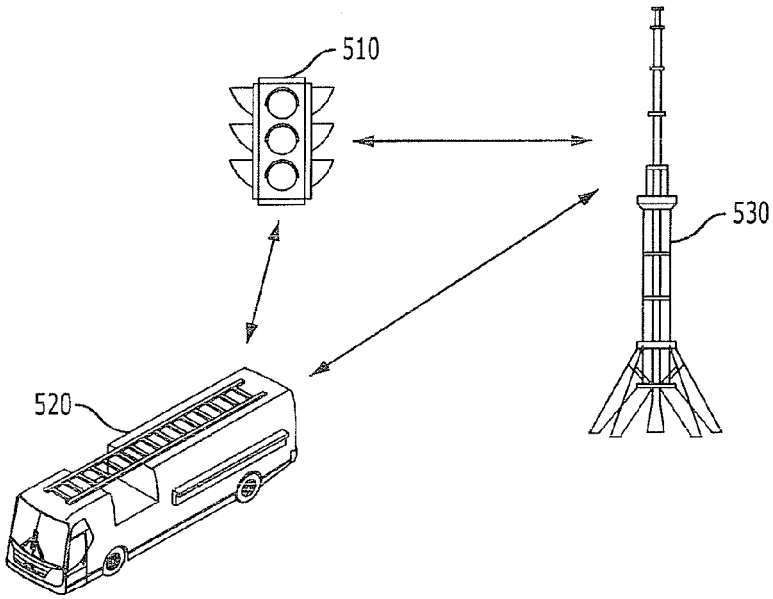
FIG. 5 is a configuration diagram of a traffic light control network in an emergency.

FIG. 5 is a configuration diagram of a traffic light control network in an emergency.

In FIG. 5, the traffic light control network includes a traffic light 510 including a traffic light control unit, an emergency vehicle 520 including an emergency vehicle control unit, and a base station or central control station 530 which provides information of a specific emergency. The traffic light 510, the emergency vehicle 520, and the central control station 530 may transmit and receive emergency information and control signals through a wireless network. The traffic light 510 and the central control station 530 may be connected to each other through a wired network.

Figure 6:
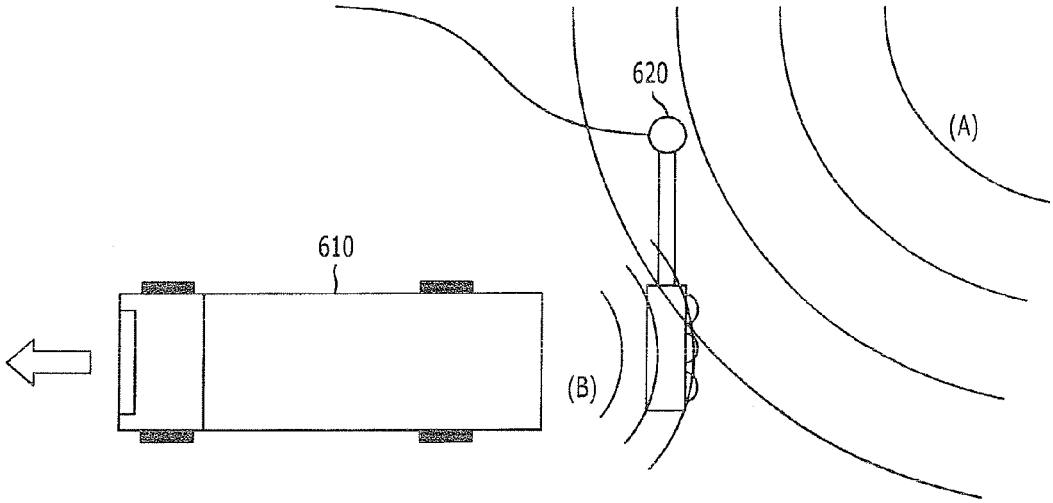
FIG. 6 is a configuration diagram of an emergency vehicle control system in accordance with an embodiment of the present invention.

FIG. 6 is a configuration diagram of an emergency vehicle control system in accordance with the embodiment of the present invention.

In FIG. 6, a traffic light 620 includes a traffic light control unit, and an emergency vehicle 610 includes an emergency vehicle control unit. Hereafter, it is assumed that a traffic light basically includes a traffic light control unit, and an emergency vehicle basically includes an emergency vehicle control unit. To support the emergency vehicle, the traffic light control unit of the traffic light 620 receives a control signal A provided from the central control station 530 to control the traffic light 620. Furthermore, the traffic light control unit of the traffic light 620 receives a control mode cancellation request signal B indicating an end of an emergency from the emergency vehicle 610, and then cancels the control mode.

Figure 7:
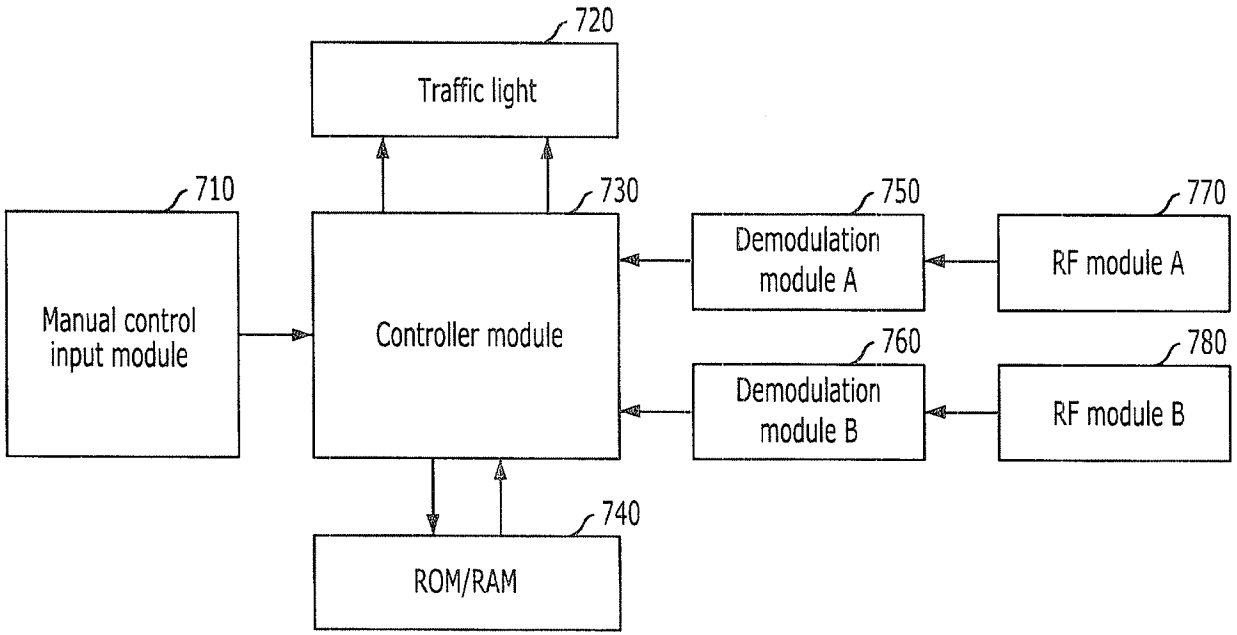
FIG. 7 is a configuration diagram of a traffic light control unit of FIG. 6 in accordance with the embodiment of the present invention.

FIG. 7 is a configuration diagram of the traffic light control unit of FIG. 6 in accordance with the embodiment of the present invention.

Referring to FIG. 7, the traffic light control unit includes a manual control input module 710, a traffic light 720, a controller module 730, a ROM/RAM 740, a demodulation module A 750, a demodulation module B 760, a radio frequency (RF) module A 770, and an RF module B 780. In this configuration, the demodulation module A 750, the demodulation module B 760, the RF module A 770, and the RF module B 770 are referred to as a signal reception unit.

The RF module A 770 frequency-down converts a signal transmitted from the central control station 530 through wireless/wired communication, and then transfers the converted signal to the demodulation module A 750. The demodulation module A 750 demodulates the signal transferred from the RF module A 770, and then transmits the demodulated signal to the control module 730. The manual control input module 710 transmits a signal for manually controlling the traffic light to the controller module 730. The controller module 730 controls the traffic light using the signal received from the demodulation module A 750 and the signal received from the manual control input module 710.

The RF module B 780 receives a traffic light control mode cancellation request signal from an emergency vehicle, and then transfer the received signal to the demodulation module B 760. Then demodulation module B 760 demodulates the transferred signal to transmit to the controller module 730. The controller module 730 completes the control of the traffic light. Furthermore, the controller module 730 controls the ROM/RAM 740 to store and update information.

Figure 8:
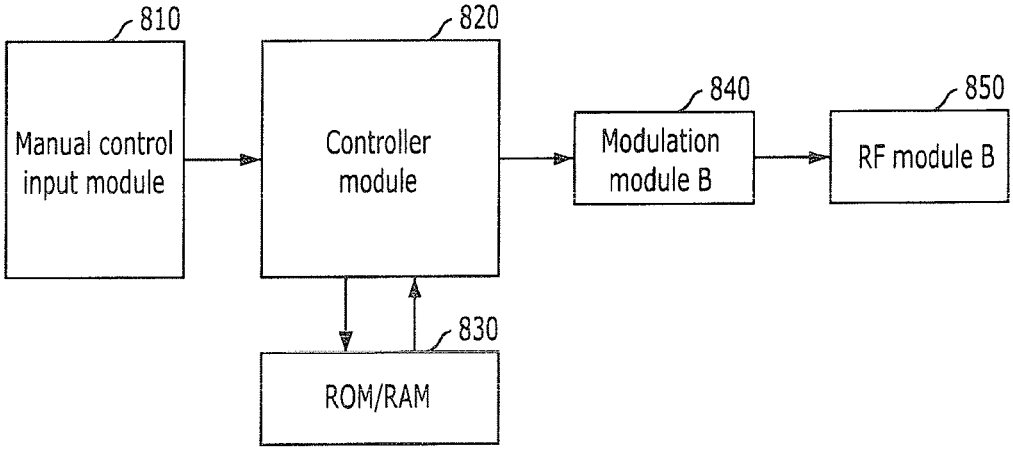
FIG. 8 is a configuration diagram of an emergency vehicle control unit of FIG. 6 in accordance with the embodiment of the present invention.

FIG. 8 is a configuration diagram of the emergency vehicle control unit of FIG. 6.

Referring to FIG. 8, the emergency vehicle control unit includes a manual control input module 810, a controller module 820, a ROM/RAM 830, a modulation module B 840, and an RF module B 850.

Referring to FIG. 8, the operation of the emergency vehicle control unit will be described. The controller module 820 generates a traffic light control cancellation signal to transfer to the modulation module B 840. The modulation module 840 modulates this signal to transfer to the RF module B 850. The RF module B 850 processes the transferred signal into a predetermined RF signal, and then transmits the processed RF signal. The manual control input module 810 transmits a signal for manually controlling the emergency vehicle control unit to the controller module 820, and the controller module 820 controls the ROM/RAM 830 to store and update information.

Figure 9:
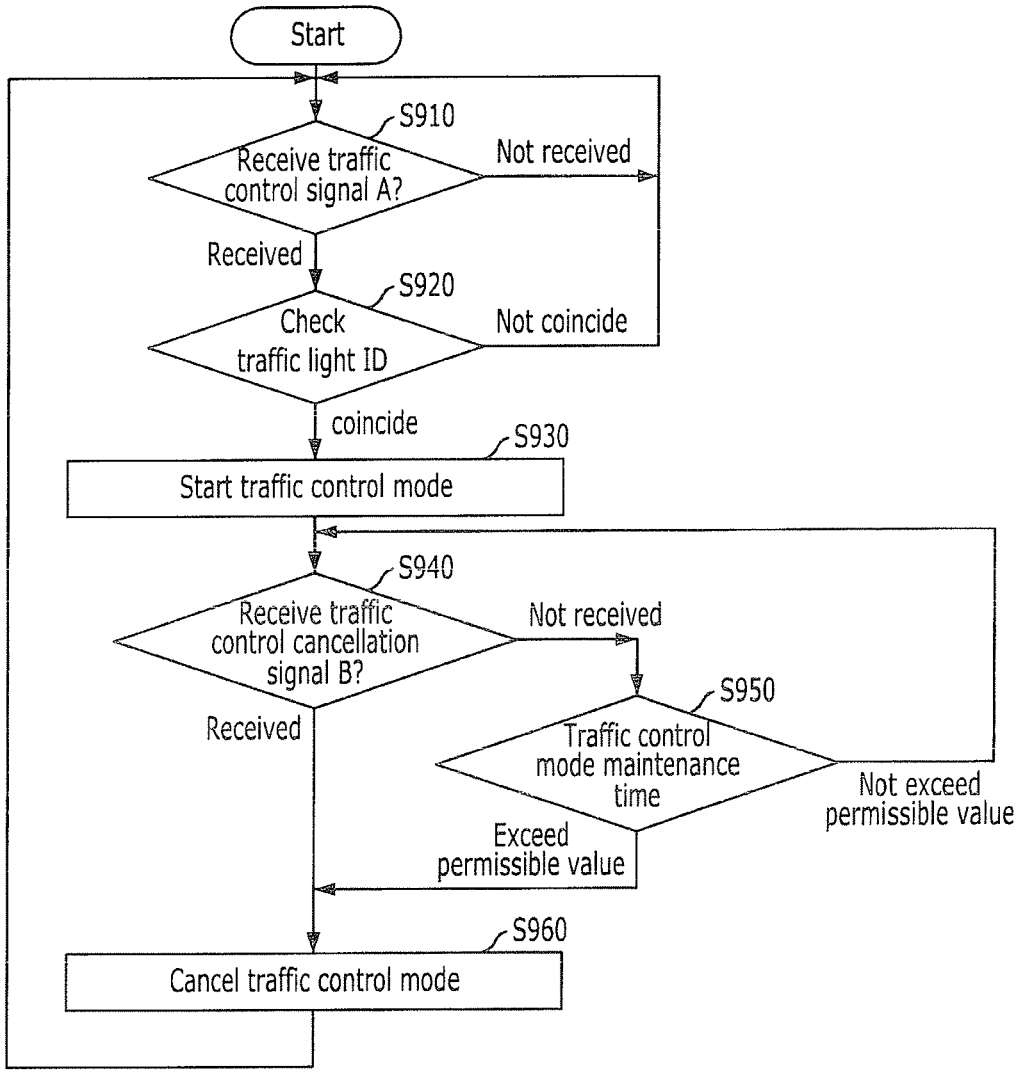
FIG. 9 is a flowchart explaining the traffic light control of the traffic light control unit of FIG. 6.

FIG. 9 is a flowchart explaining the traffic light control of the traffic light control unit of FIG. 6.

The traffic light control unit determines whether or not a traffic light control signal A is received from the traffic network control unit at a step S910. When receiving the traffic light control signal A, the traffic light control unit checks whether or not a traffic light ID included in the received signal coincides with the ID of the corresponding traffic light at a step S920. When a traffic light control signal A is not received, the traffic light control unit continuously waits for a signal control signal A. When it is checked at the step S920 that the traffic light ID coincides with the ID of the corresponding traffic light, a traffic light control mode starts at a step S930. When it is checked at the step S920 that the traffic light ID does not coincide with the ID of the corresponding traffic light, the operation returns to the step S910 such that the traffic light control unit waits for a traffic light control signal A. The traffic light control unit checks whether a traffic light control cancellation signal B transmitted from the emergency vehicle is received or not at a step S940. When receiving a traffic light control cancellation signal, the traffic light control unit cancels the traffic light control mode at a step S960, and the operation returns to the step S910 such that the traffic light control unit receives a next traffic light control signal. When a traffic light control cancellation signal is not received at the step S940, the traffic light control unit may use a predetermined traffic light control mode maintenance time to cancel the traffic light control mode which may unnecessarily continue. That is, the traffic light control unit determines whether the duration of the traffic light control mode exceeds the traffic light control mode maintenance time or not at a step S950. When it is determined that the duration of the traffic light control mode does not exceed the traffic light control mode maintenance time, the operation returns to the step S940 such that the traffic light control unit receives a traffic light control cancellation signal. When it is determined that the duration of the traffic light control mode exceeds the traffic light control mode maintenance time, the operation proceeds to the step S960 such that the traffic light control unit cancels the traffic light control mode. After the traffic light control mode is canceled, the traffic light control unit waits for a traffic light control signal in another emergency.

Figure 10:
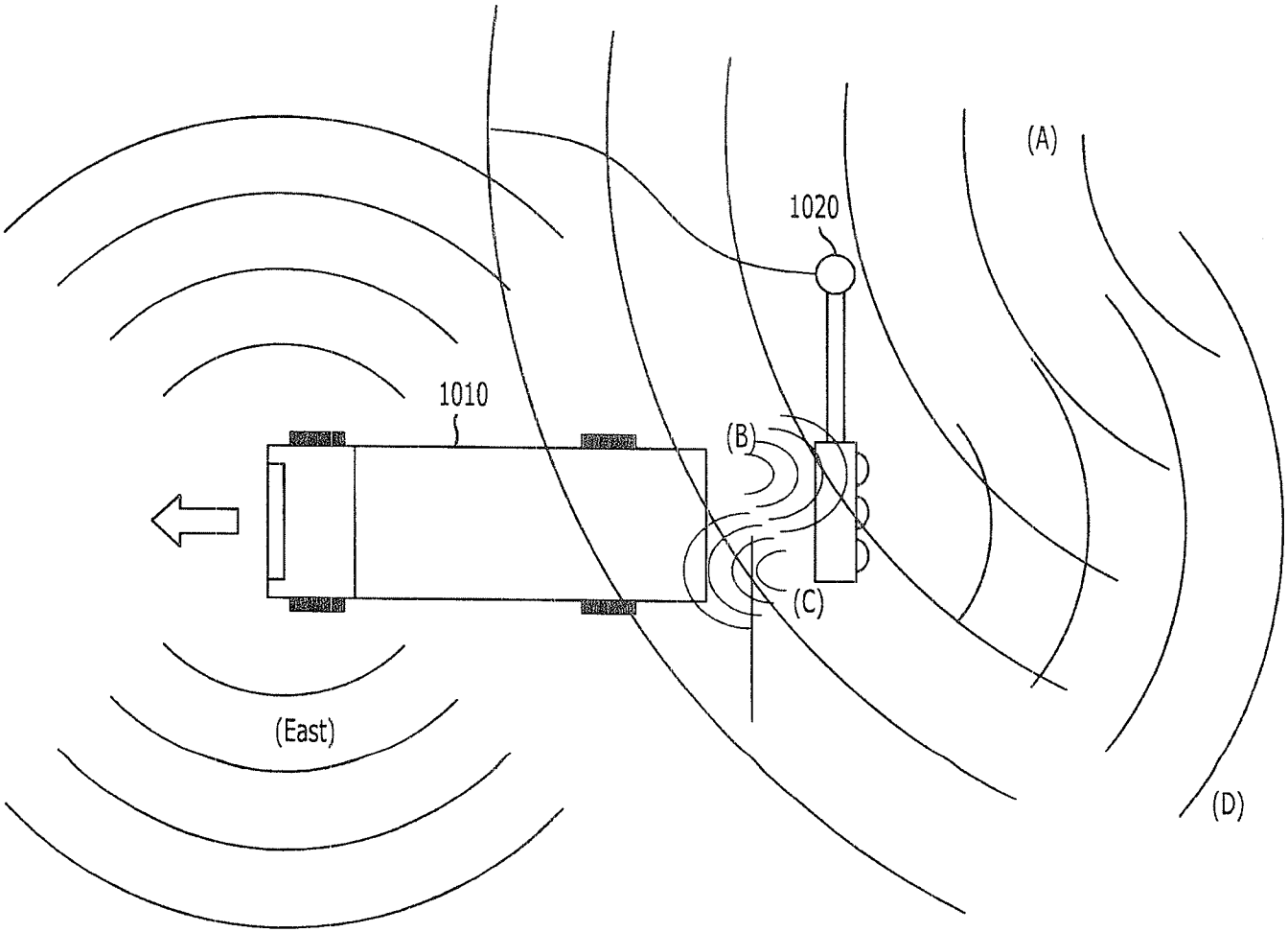
FIG. 10 is a configuration diagram of an emergency vehicle control system in accordance with another embodiment of the present invention.

FIG. 10 is a configuration diagram of an emergency vehicle control system in accordance with another embodiment of the present invention.

While unidirectional control signals are transmitted and received in the configuration of FIG. 6, bidirectional control signals may be transmitted and received in the configuration of FIG. 10. As in the configuration of FIG. 6, a traffic light 1020 includes a traffic light control unit, and an emergency vehicle 1010 includes an emergency vehicle control unit. In FIG. 10, a signal A represents a control signal which the central control station transmits to the traffic light, a signal B represents a control mode cancellation request signal which the emergency vehicle transmits to the traffic light, a signal C represents a traffic light ID signal which the traffic light transmits to the emergency vehicle, a signal D represents a control mode state confirm signal which the traffic light transmits to the traffic network control unit, and a signal E represents a control cancellation completion signal which the emergency vehicle transmits to the traffic network control unit.

Figure 11:
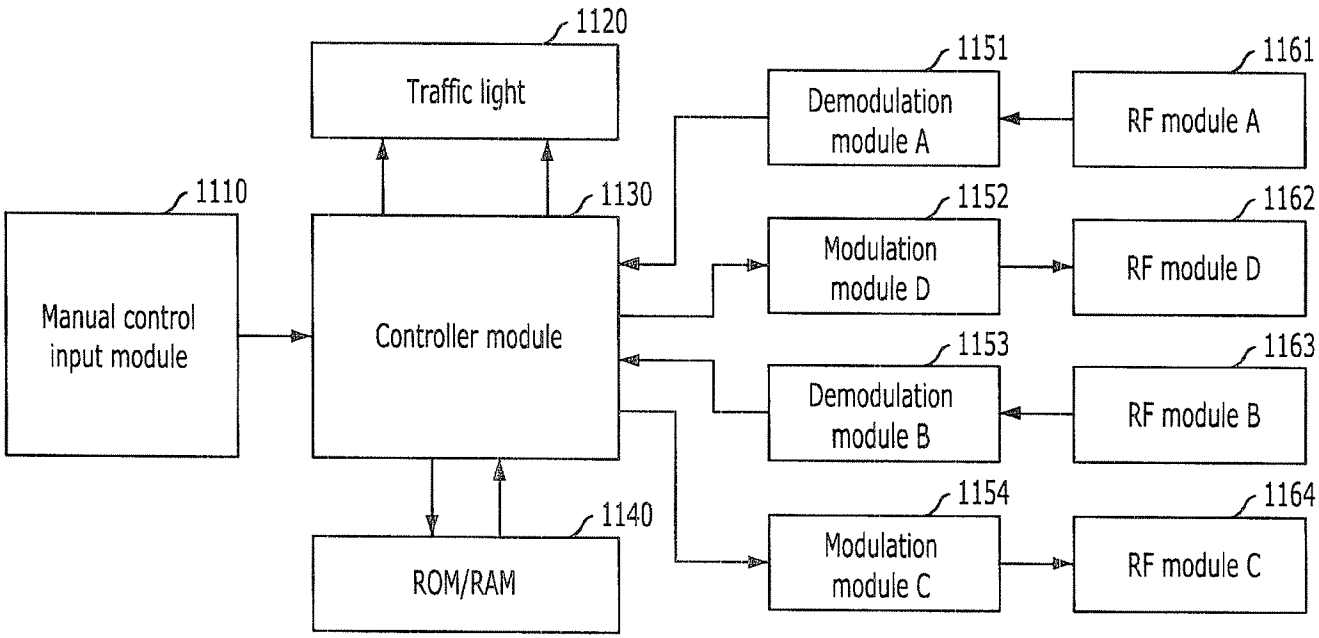
FIG. 11 is a configuration diagram of a traffic light control unit of FIG. 10 in accordance with the embodiment of the present invention.

FIG. 11 is a configuration diagram of the traffic light control unit of FIG. 10 in accordance with the embodiment of the present invention.

Referring to FIG. 11, the traffic light control unit includes a manual control input module 1110, a traffic light 1120, a controller module 1130, a ROM/RAM 1140, a demodulation module A 1151, an RF module A 1161, a modulation module D 1152, an RF module D 1162, a demodulation module B 1153, an RF module B 1163, a modulation module C 1154, and an RF module C 1164.

Referring to FIG. 11, the operation of the traffic light control unit will be described. The demodulation module A 1151, the RF module A 1161, the demodulation module B 1153, and the RF module B 1163 are referred to as a signal reception unit, and the modulation module D 1152, the RF module D 1162, the modulation module C 1154, and the RF module C 1164 are referred to as a signal transmission unit.

The RF module A 1161 frequency-down converts a signal received from the traffic network control unit through wireless/wired communication, and then transfers the converted signal to the demodulation module A 1151. The demodulation module A 1151 demodulates the signal transferred from the RF module A 1161, and transfers the demodulated signal to the controller module 1130. The manual control input module 1110 transfers a signal for manually controlling the traffic light to the controller module 1130. The controller module 1130 transfers a signal to the modulation module D 1152, the signal informing that the traffic light control unit enters into the traffic light control mode, or the traffic light control mode is cancelled. The modulation module D 1152 modulates the signal transferred from the controller module 1130 through a predetermined modulation scheme, and then transfers the modulated signal to the RF module D 1162. The RF module D 1162 generates an RF signal agreeing with a predetermined standard, and then transmits the generated RF signal to the traffic network control unit through wireless/wired communication.

When the traffic light control unit enters into the control mode, the controller module 1130 a traffic light ID signal to the modulation module C 1154 on the basis of the control signal transmitted from the traffic network control unit or the signal transferred from the manual control input module 1110. The modulation module C 1154 modulates the signal generated from the controller module 1130 through a predetermined modulation scheme, and then transfers the modulated signal to the RF module C 1164. The RF module C 1164 generates an RF signal agreeing with a predetermined standard, and transmits the generated RF signal to the emergency vehicle through wireless communication. The controller module 1130 controls the traffic light using the control signal received from the demodulation module A 1151 and the signal received from the manual control input module 1110.

The RF module B 1163 receives a traffic light control mode cancellation request signal from the emergency vehicle, and processes the received signal to transfer to the demodulation module B 1153. The demodulation module B 1153 demodulates the traffic light control mode cancellation request signal transferred from the RF module B 1163, and then transfers the demodulated signal to the controller module 1130. The controller module 1130 completes the control of the traffic light, transmits a control mode cancellation confirm signal through the modulation module D 1152 and the RF module D 1162, and stops transmitting the traffic light ID signal. Furthermore, the controller module 1130 controls the ROM/RAM 1140 to store and update information.

Figure 12:
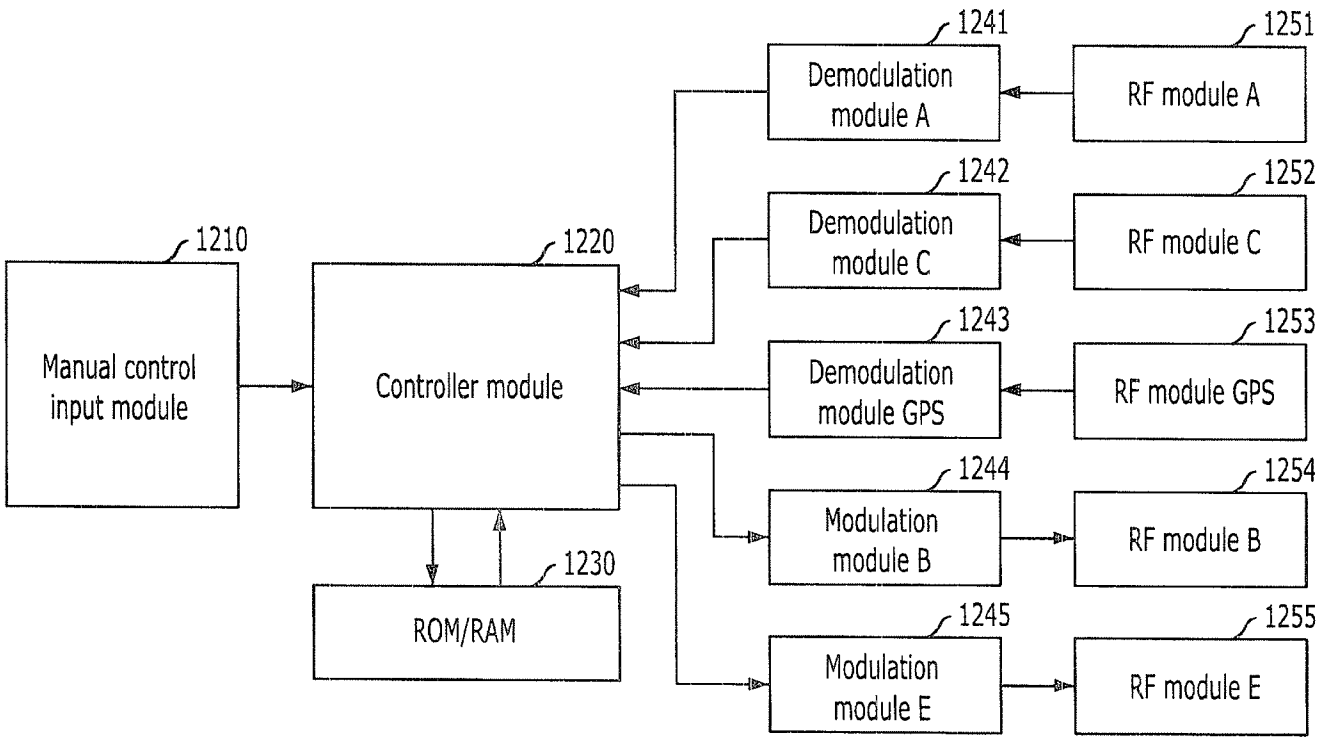
FIG. 12 is a configuration diagram of an emergency vehicle control unit of FIG. 10 in accordance with the embodiment of the present invention.

FIG. 12 is a configuration diagram of the emergency vehicle control unit of FIG. 10.

Referring to FIG. 12, the emergency vehicle control unit includes a manual control input module 1210, a controller module 1220, a ROM/RAM 1230, a demodulation module A 1241, an RF module A 1251, a demodulation module C 1242, an RF module C 1252, a demodulation module GPS 1243, an RF module GPS 1253, a modulation module B 1244, an RF module B 1254, a modulation module E 1245, and an RF module E 1255.

Referring to FIG. 12, the operation of the emergency vehicle including the emergency vehicle control unit will be described. The demodulation module A 1241, the RF module A 1251, the demodulation module C 1242, the RF module C 1252, the demodulation module GPS 1243, and the RF module GPS 1253 are referred to as a signal reception unit, and the modulation module B 1244, the RF module 1254, the modulation module E 1245, and the RF module E 1255 are referred to as a signal transmission unit.

The RF module A 1251, the RF module C 1252, and the RF module GPS 1253 receive a signal A transmitted from the traffic network control unit, a traffic light ID signal C of the traffic light, and a GPS signal, respectively, and then transfer the received signals to the demodulation module A 1241, the demodulation module C 1242, and the demodulation module GPS 1243, respectively. The demodulation module A 1241, the demodulation module C 1242, and the demodulation module GPS 1243 demodulates the signals transferred from the respective RF modules, and transfers the demodulated signals to the controller module 1220. The controller module 1220 receives the signals transferred from the respective demodulation modules and an input signal of the manual control input module 1210. The controller module 1220 compares the ID of the traffic light or a current vehicle position of a GPS system to determine whether the emergency vehicle passed the traffic light or not, or generates a traffic light control mode cancellation request signal based on the input signal of the manual control input module and transfers the generated signal to the modulation module B 1244. The modulation module B 1244 modulates the transferred control mode cancellation request signal to transfer to the RF module B 1254. The RF module B 1254 processes the transferred signal into a predetermined RF signal, and transmits the processed RF signal. To inform the traffic network control unit that the cancellation of the control mode of the traffic light was completed, the controller module 1220 controls the modulation module E 1245 to modulate a control mode cancellation completion signal, and transmits the modulated signal through the RF module E 1255.

Figure 13:
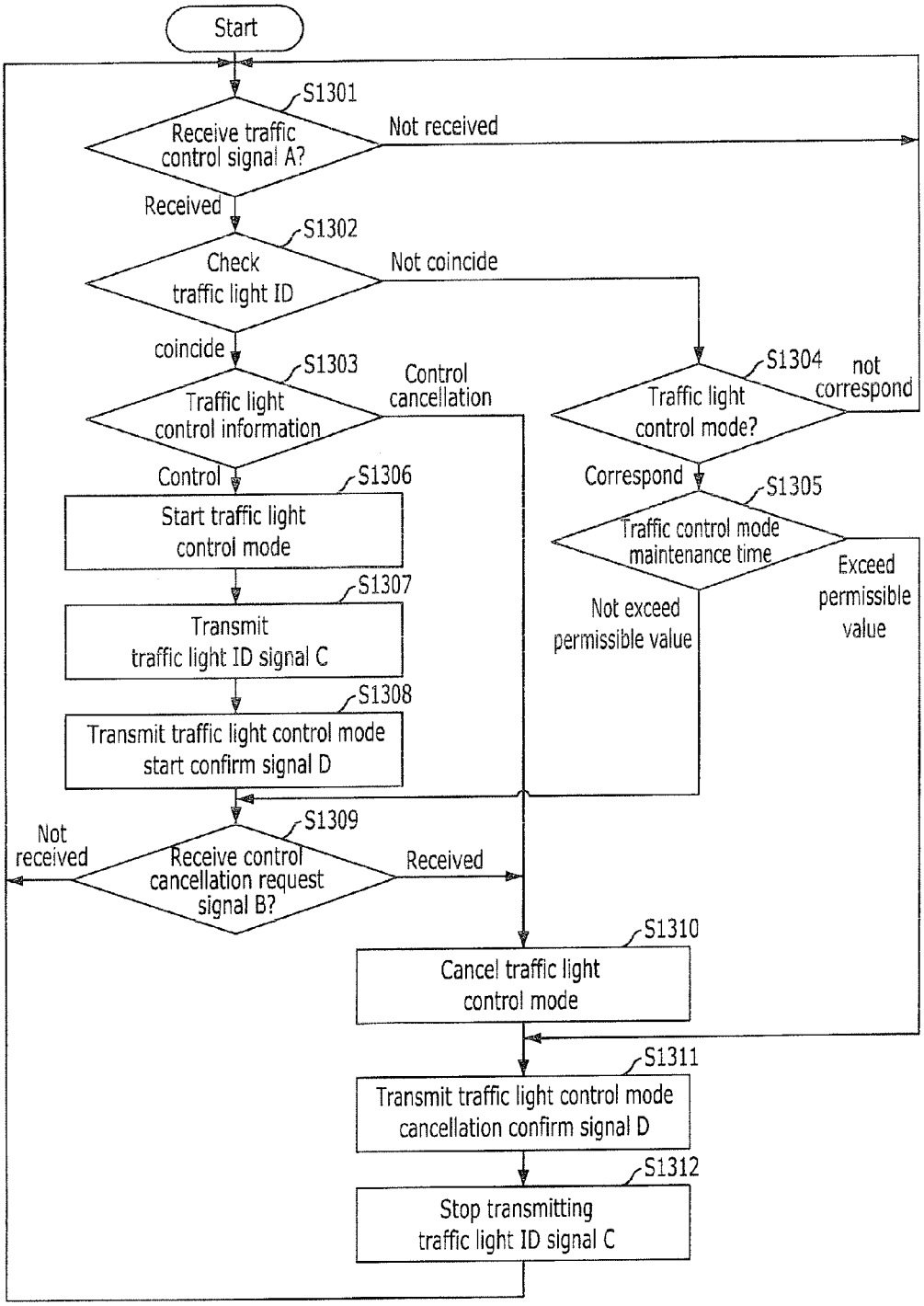
FIG. 13 is a traffic light control flowchart in accordance with the embodiment of FIG. 10.

FIG. 13 is a traffic light control flowchart in accordance with the embodiment of FIG. 10.

The traffic light control unit determines whether a traffic light control signal A is received or not at a step S1301. When receiving the traffic light control signal A, the traffic light control unit determines whether a traffic light ID included in the traffic light control signal A coincides with the ID of the corresponding traffic light or not at a step S1302. When a traffic light control signal A is not received, the traffic light control unit continuously waits for a traffic light control signal A. When it is determined at the step S1032 that the traffic light ID coincides with the ID of the corresponding traffic light, the traffic light control unit determines whether the traffic light control signal A is a signal for controlling the traffic light or a signal for cancelling the traffic light control mode at a step S1303. When it is determined at the step S1303 that the traffic light control signal A is a control signal, the traffic light control mode starts at a step S1306, a traffic light ID signal C is transmitted at a step S1307, and a start confirm signal D is transmitted to the traffic network control unit at a step S1308. When it is determined at the step S1303 that the traffic light control signal A is a signal for cancelling the traffic light control mode, the traffic light control mode is canceled at a step S1310, and a traffic light control mode cancellation confirm signal D is transmitted at a step S1311. The traffic light control unit stops transmitting the signal ID signal C at a step S1312, and waits for a next traffic light control signal.

When the traffic light is controlled using a timer, or when it is determined at the step S1302 that the traffic light ID does not coincide with the ID of the corresponding traffic light, the traffic light control unit determines whether a current mode is the traffic light control mode or not at a step S1304. When the current mode is not the traffic light control mode, the operation returns to the step S1301 such that the traffic light control unit waits for a traffic light control signal A. When the current mode is the traffic light control mode, the traffic light control unit determines whether the duration of the traffic light control mode exceeds a permissible value or not at a step S1305. When the duration of the traffic light control mode exceeds the permissible value, the operation proceeds to the step S1311 such that the traffic light control unit transmits a traffic light control mode cancellation confirm signal D, and the traffic light control unit stops transmitting the traffic light ID signal C at the step S1312. Then, the operation returns to the step S1301 such that the traffic light control unit waits for a next traffic light control signal. When the duration of the traffic light control mode does not exceed the permissible value, the operation proceeds to a step S1309 such that the traffic light control unit waits for a control cancellation request signal B.

When the control cancellation request signal B is received at the step S1309, the traffic light control mode is cancelled at the step S1310, and a traffic light control mode cancellation confirm signal is transmitted at the step S1311. The traffic light control unit stops transmitting the traffic light ID signal C at the step S1312. Then, the operation returns to the step S1301 such that the traffic light control unit waits for a next traffic light control signal.

Figure 14:
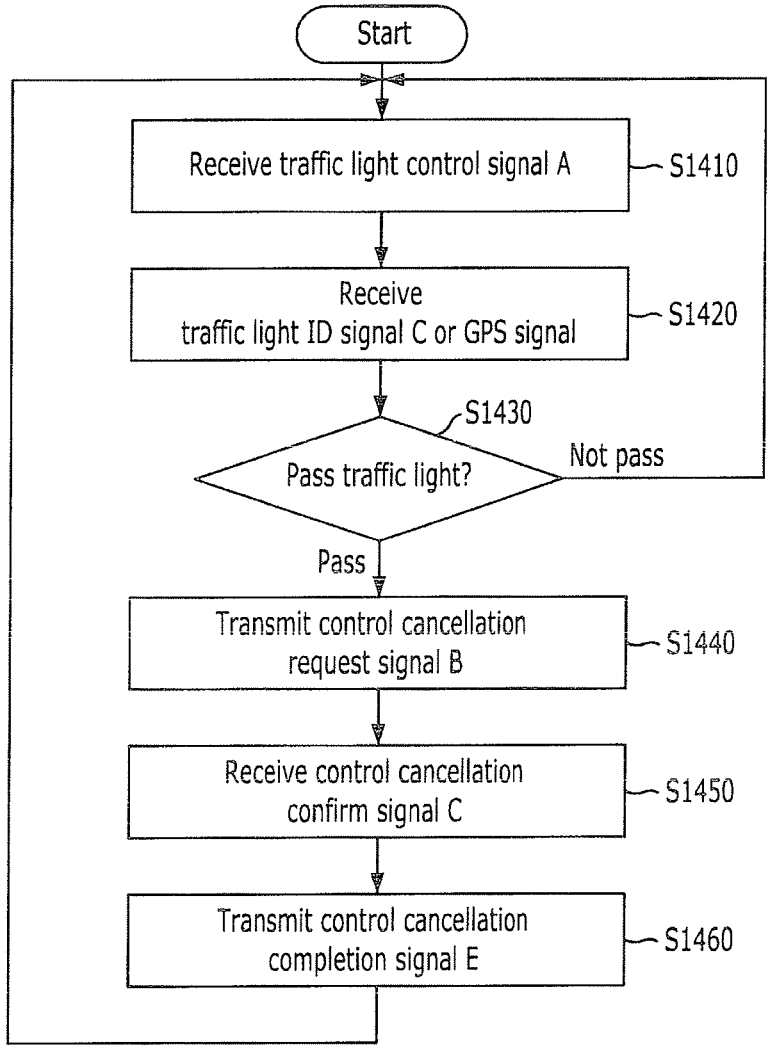
FIG. 14 is an emergency vehicle control flowchart in accordance with the embodiment of FIG. 10.

FIG. 14 is an emergency vehicle control flowchart in accordance with the embodiment of FIG. 10.

The emergency vehicle control unit receives a traffic light control signal A transmitted from the traffic network control unit at a step S1410, and receives a traffic light ID signal C or GPS signal at a step S1420. The emergency vehicle control unit determines whether the emergency vehicle passed the traffic light or not, based on the received signals, at a step S1430. When determining that the emergency vehicle passed the traffic light, the emergency vehicle control unit transmits a control cancellation request signal B at a step S1440. The emergency vehicle control unit receives a control cancellation confirm signal C from the traffic light control unit at a step S1450, and transmits a control cancellation completion signal at a step S1460. Then, the operation returns to the step S1410 such that the emergency vehicle control unit waits for a next traffic light control signal.

When the traffic light control apparatus and method in accordance with the embodiments of the present invention is applied, it is possible to prevent other vehicles from entering into the moving path of the emergency vehicle. Furthermore, vehicles or pedestrians having no relation with the moving path may be guaranteed to travel their way or take a crosswalk. Therefore, the effective moving path of the emergency vehicle may be secured while an effect upon other vehicles and pedestrians is minimized.

FIGS. 15 to 21 show applied examples in which the traffic light control method in accordance with the embodiment of the present invention is applied.

Figure 15:
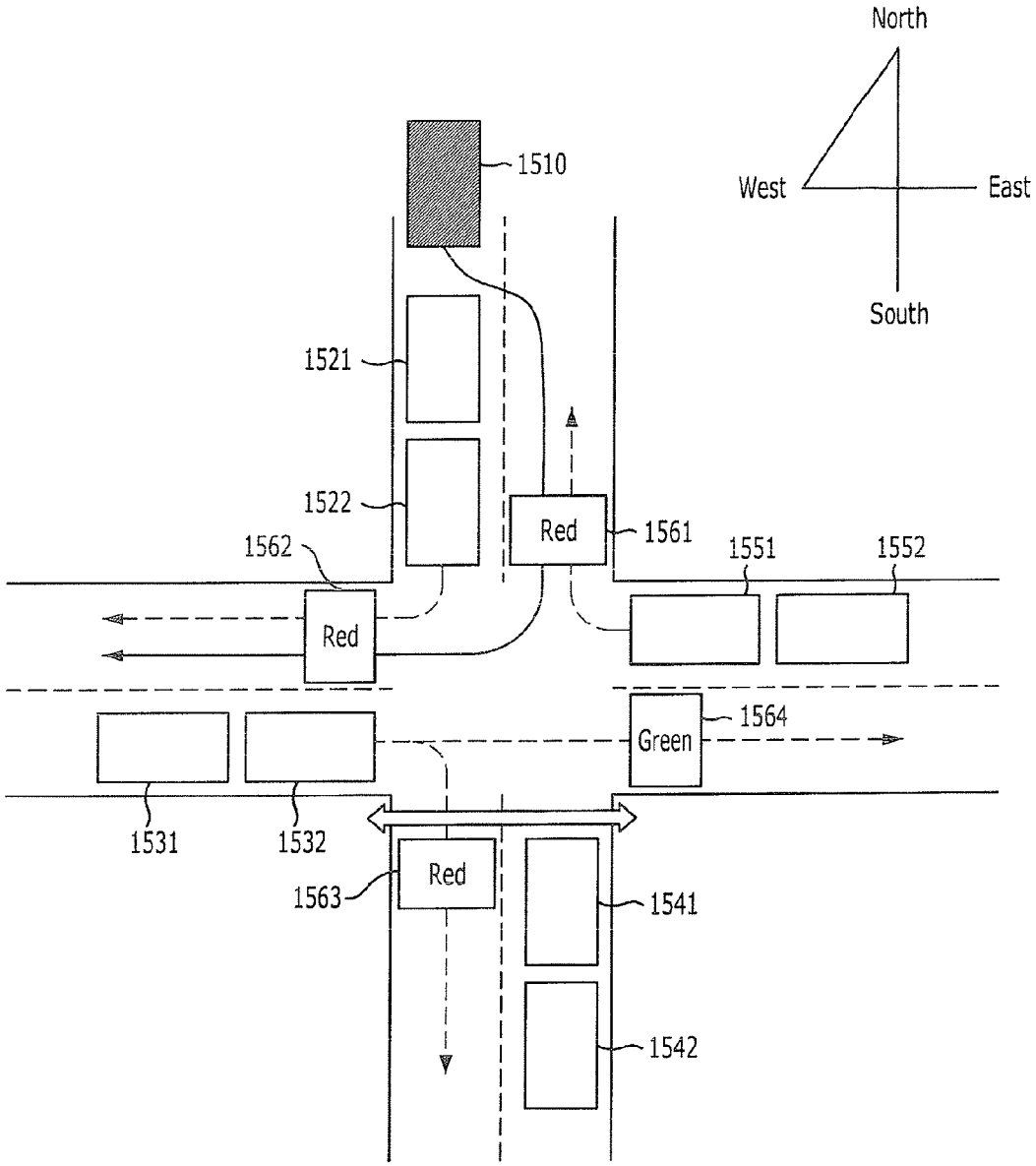
FIG. 15 shows a first applied example of the traffic light control method in accordance with the embodiment of the present invention, illustrating a situation in which an emergency vehicle is to make a right turn in an intersection on a roadway with no median strip.

FIG. 15 shows the first applied example of the traffic light control method in accordance with the embodiment of the present invention, illustrating a situation in which an emergency vehicle is to make a right turn in an intersection on a roadway with no median strip. An emergency vehicle 1510 entering from the north is to make a right turn to the west. In this case, a north traffic light 1561, a west traffic light 1562, and a south traffic light 1563 are set to display a red light such that the emergency vehicle may pass through the intersection using an opposite lane, that is, a lane where vehicles enters from the south to the north. On the other hand, an east traffic light 1564 is set to display a green light such that vehicles entering from the west may go straight or make a right turn and vehicles entering from the east may make a right turn. Furthermore, a south crosswalk traffic light is set to display a green light such that pedestrians may take a crosswalk.

Figure 16:
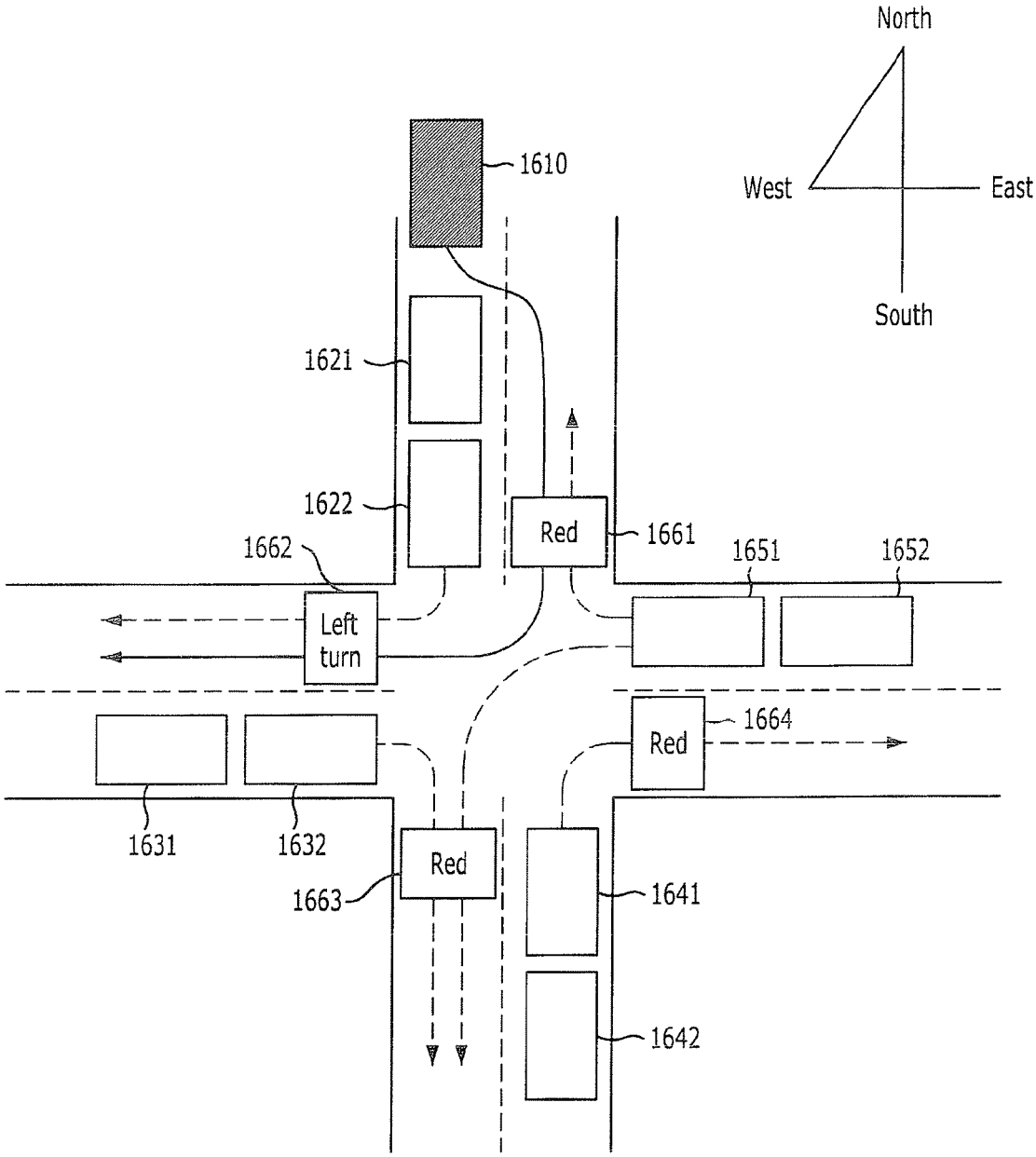
FIG. 16 shows a second applied example of the traffic light control method in accordance with the embodiment of the present invention, illustrating a situation in which an emergency vehicle is to make a right turn in an intersection on a roadway with no median strip.

FIG. 16 shows the second applied example of the traffic light control method in accordance with the embodiment of the present invention, illustrating a situation in which an emergency vehicle is to make a right turn in an intersection on a roadway with no median strip.

FIG. 16 illustrates the same situation as that of FIG. 15. In this case, a north traffic light 1661, an east traffic light 1664, and a south traffic light 1663 are set to display a red light such that vehicles are prevented from entering into the moving direction of an emergency vehicle 1610. On the other hand, a west traffic light 1662 is set to display a left-turn signal such that vehicles having no relation with the moving direction of the emergency vehicle 1610 may enter into the intersection.

Figure 17:
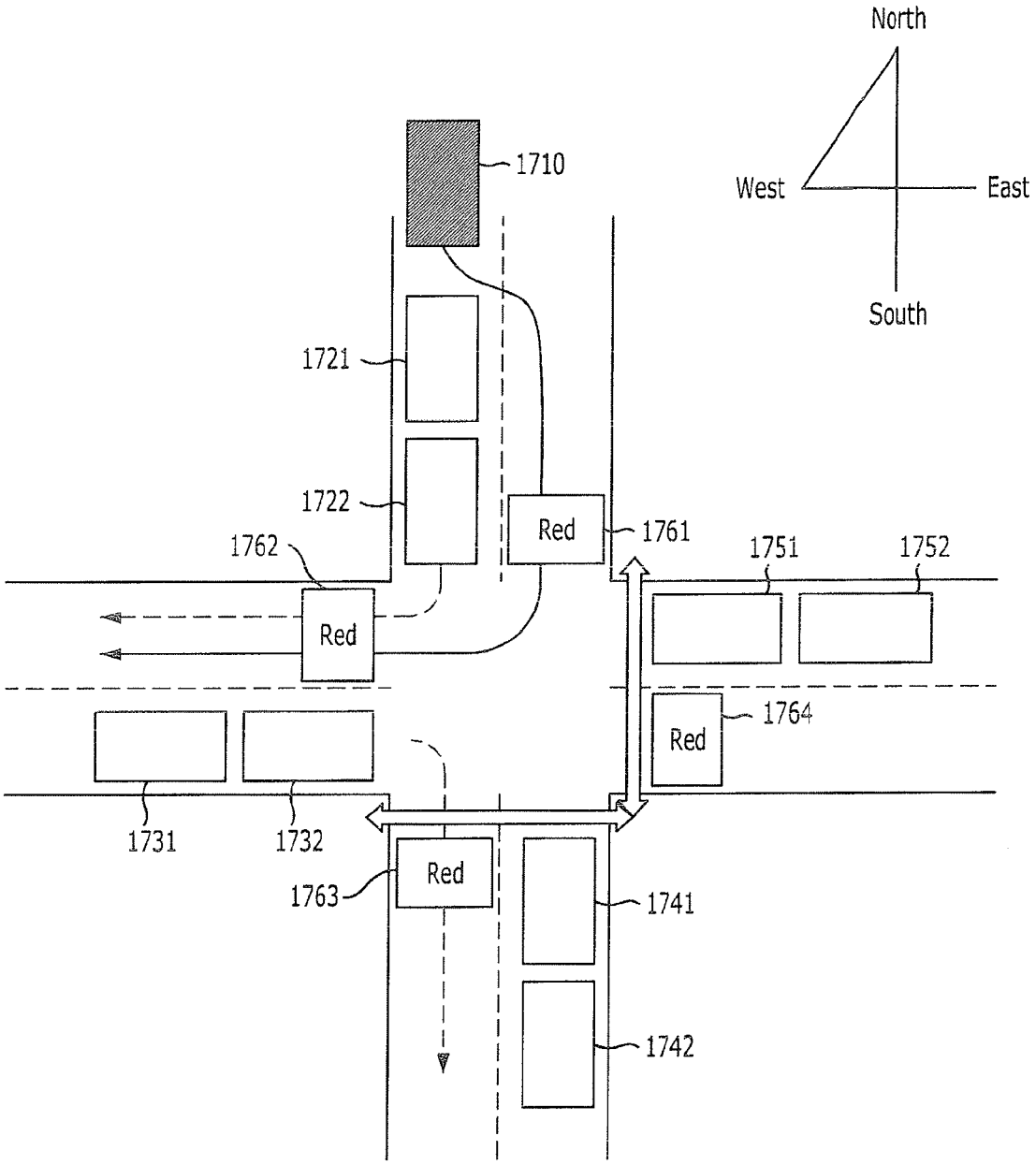
FIG. 17 shows a third applied example of the traffic light control method in accordance with the embodiment of the present invention, illustrating a situation in which an emergency vehicle is to make a right turn in an intersection on a roadway with no median strip.

FIG. 17 shows the third applied example of the traffic light control method in accordance with the embodiment of the present invention, illustrating a situation in which an emergency vehicle is to make a right turn in an intersection on a roadway with no median strip. FIG. 17 illustrates the same situation as those of FIGS. 15 and 16. In this case, traffic lights

1761, 1762, 1763, and 1764 in four directions are all set to display a red light. At this time, south and east crosswalk traffic lights are set to display a green light such that pedestrians may take a crosswalk.

In the situation in which an emergency vehicle is to make a right turn in an intersection on a roadway with no median strip, the traffic light control methods proposed in FIGS. 15 to 17 may be time-shared and applied.

Figure 18:
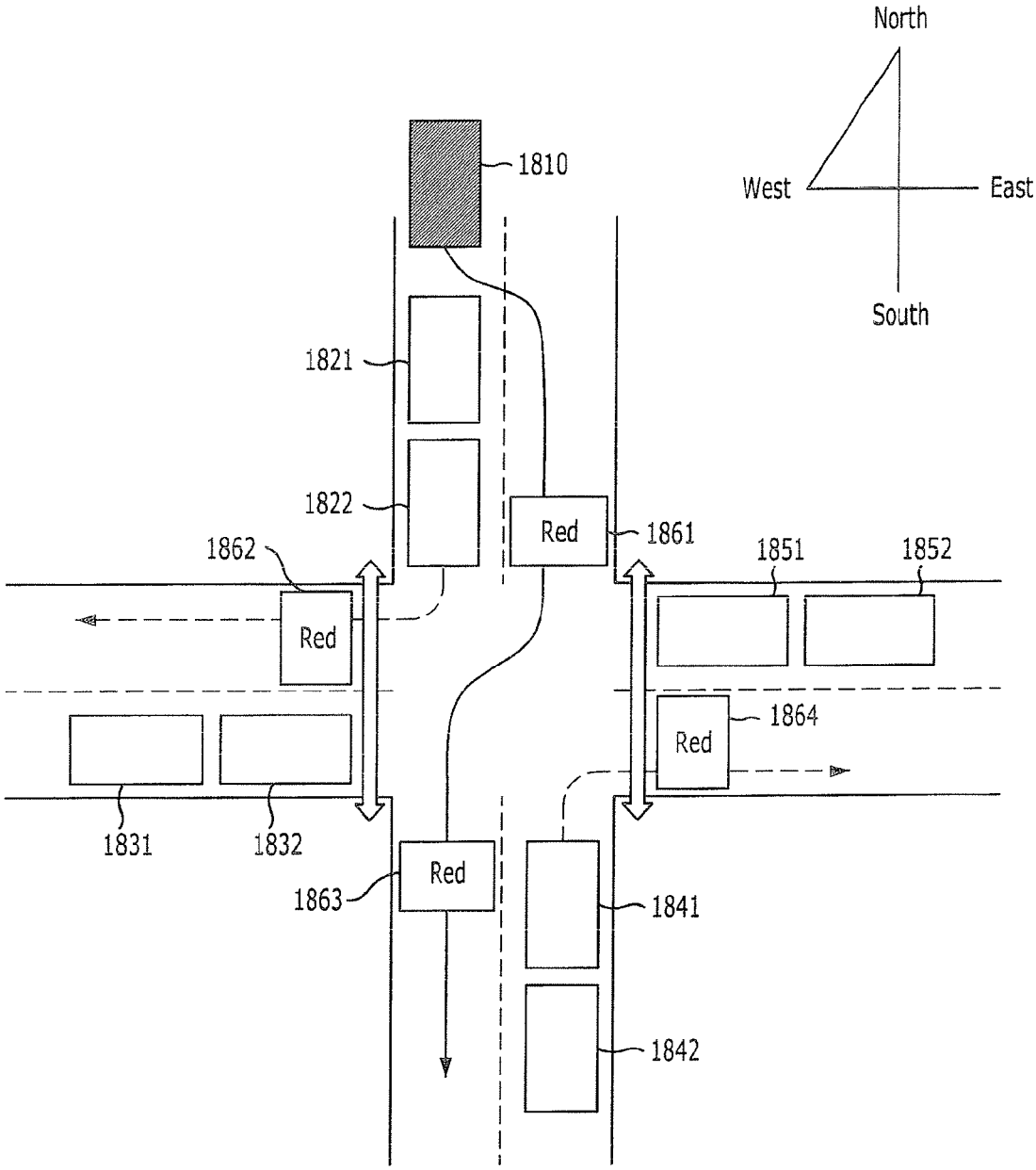
FIG. 18 shows a fourth applied example of the traffic light control method in accordance with the embodiment of the present invention, illustrating a situation in which an emergency vehicle is to go straight in an intersection on a roadway with no median strip.

FIG. 18 shows the fourth applied example of the traffic light control method in accordance with the embodiment of the present invention, illustrating a situation in which an emergency vehicle is to go straight in an intersection on a roadway with no median strip. In this case, the emergency vehicle 1810 enters from the north to travel to the south. In order to support the entrance of the emergency vehicle, traffic lights 1861, 1862, 1863, and 1864 in four directions are all set to display a red light. At this time, east and west crosswalk traffic lights are set to display a green light such that pedestrians may take a crosswalk.

Figure 19:
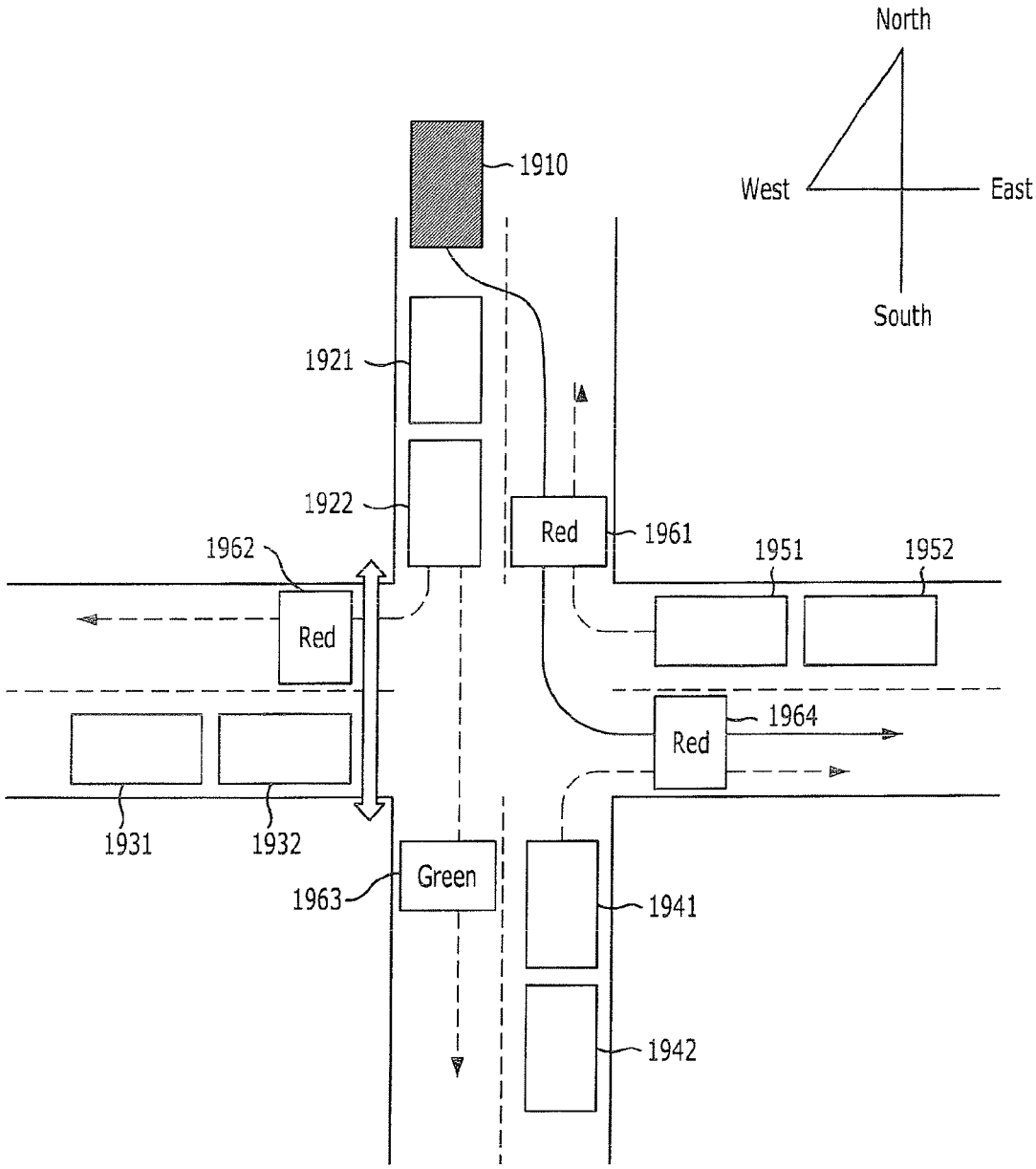
FIG. 19 shows a fifth applied example of the traffic light control method in accordance with the embodiment of the present invention, illustrating a situation in which an emergency vehicle is to make a left turn in an intersection on a roadway with no median strip.

FIG. 19 shows the fifth applied example of the traffic light control method in accordance with the embodiment of the present invention, illustrating a situation in which an emergency vehicle is to make a left turn in an intersection on a roadway with no median strip. The emergency vehicle 1910 enters from the north to travel to the east. In order to support the entrance of the emergency vehicle 1910, a north traffic light 1961, a west traffic light 1962, and an east traffic light 1964 are set to display a red light. On the other hand, since a south traffic light 1963 has no relation with the moving direction of the emergency vehicle 1910, the south traffic light 1963 is set to display a green light such that vehicles may enter into the intersection. At this time, a west crosswalk traffic light is set to display a green light such that pedestrians may take a crosswalk.

Figure 20:
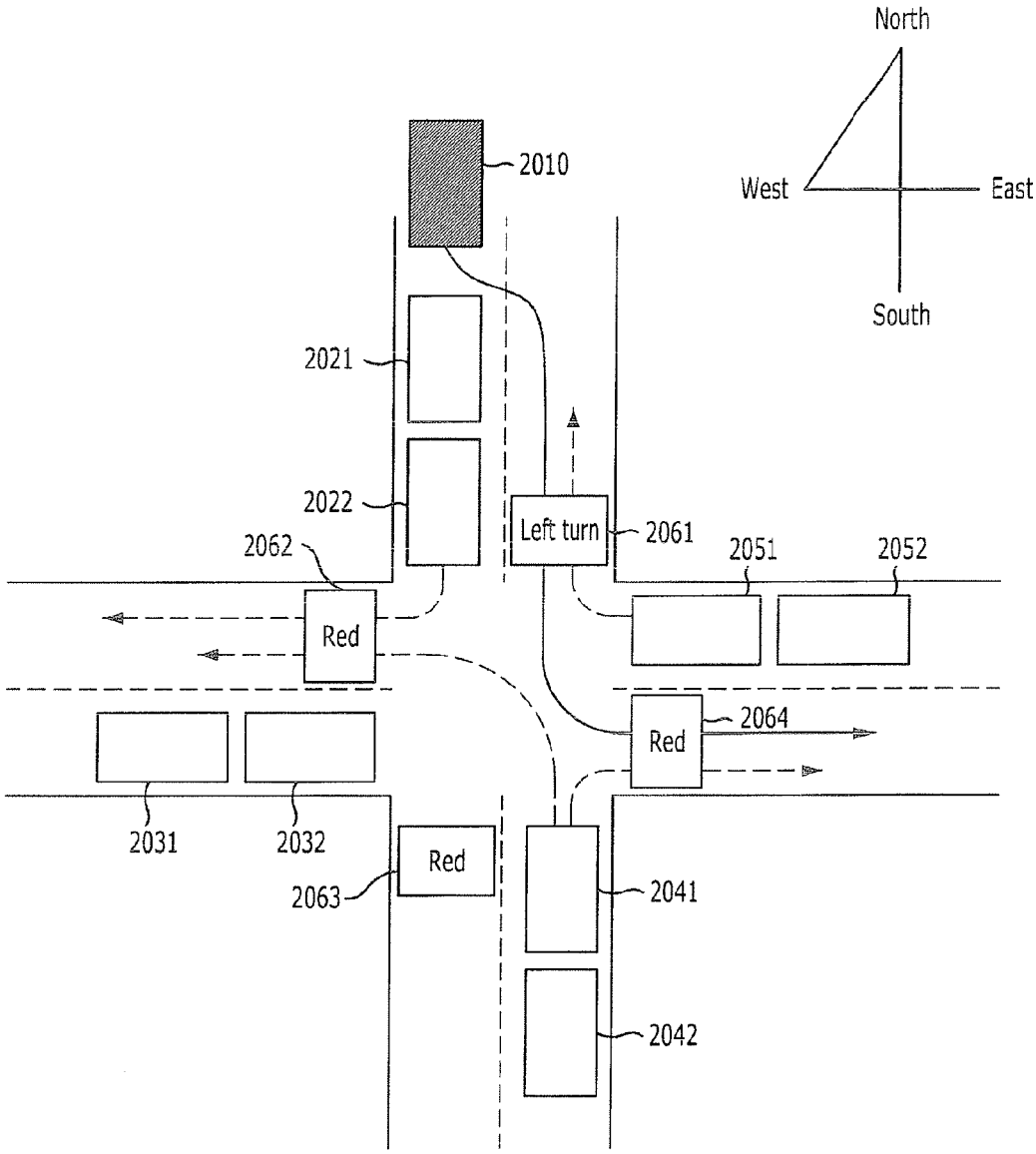
FIG. 20 shows a sixth applied example of the traffic light control method in accordance with the embodiment of the present invention, illustrating a situation in which an emergency vehicle is to make a left turn in an intersection on a roadway with no median strip.

FIG. 20 shows the sixth applied example of the traffic light control method in accordance with the embodiment of the present invention, illustrating a situation in which an emergency vehicle is to make a left turn in an intersection on a roadway with no median strip. The emergency vehicle 2010 enters from the north to travel to the east. In order to support the entrance of the emergency vehicle 2010, a south traffic light 2063, a west traffic light 2062, and an east traffic light 2064 are set to display a red light. On the other hand, a north traffic light 2061 is set to display a left-turn signal such that vehicles having no relation with the moving direction of the emergency vehicle may enter from the south to make a left turn to the west.

Figure 21:
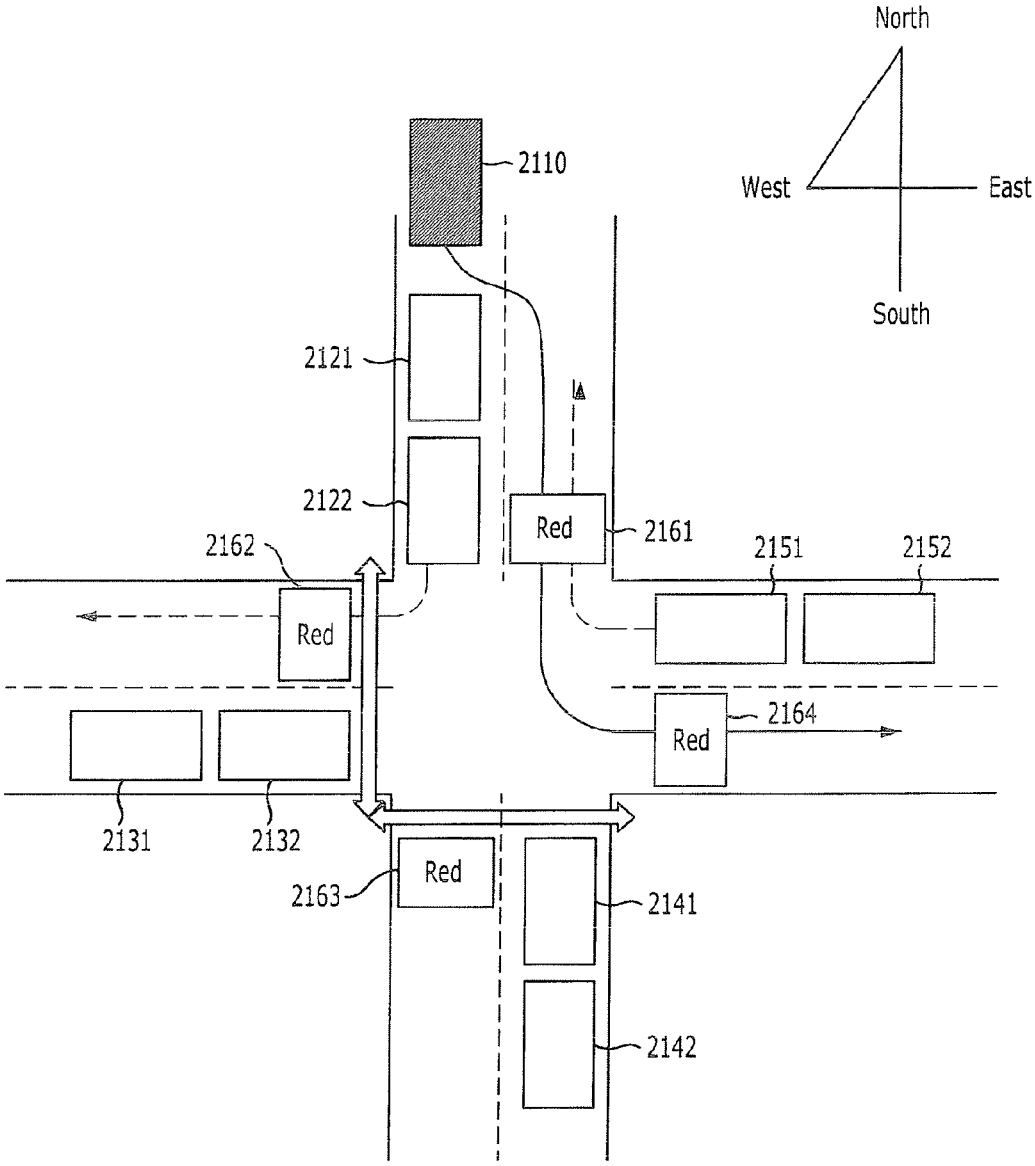
FIG. 21 shows a seventh applied example of the traffic light control method in accordance with the embodiment of the present invention, illustrating a situation in which an emergency vehicle is to make a left turn in an intersection on a roadway with no median strip.

FIG. 21 shows the seventh applied example of the traffic light control method in accordance with the embodiment of the present invention, illustrating a situation in which an emergency vehicle is to make a left turn in an intersection on a roadway with no median strip. The emergency vehicle 2110 enters from the north to travel to the east. In order to support the entrance of the emergency vehicle 2110, traffic lights 2161, 2162, 2163, and 2164 in four directions are all set to display a red light such that all vehicles are prevented from entering into the intersection. At this time, east and west crosswalk traffic lights are set to display a green light such that pedestrians may take a crosswalk.

In the situation in which an emergency vehicle is to make a left turn in an intersection on a roadway with no median strip, the traffic light control methods proposed in FIGS. 19 to 21 may be time-shared and applied.

The traffic light control apparatus and method in accordance with the embodiments of the present invention may effectively secure a path of an emergency vehicle when a fire or accident occurs or an urgent patient needs to be transported, and may minimize an effect upon traveling of other vehicles. Furthermore, as the traffic light control apparatus and method is applied to a popularized and generalized broadcasting network, the traffic light control apparatus and method may be simply implemented.

While the present invention has been described with respect to the specific embodiments, it will be apparent to those skilled in the art that various changes and modifications may be made without departing from the spirit and scope of the invention as defined in the following claims.

What is claimed is:

1. A traffic light control apparatus for controlling an emergency vehicle in a traffic network, comprising:

a traffic network control unit that determines overall traffic network control and traffic light control for supporting movement of the emergency vehicle during an emergency and transmit a control signal;

a traffic light control unit that receives the control signal to control a traffic light; and an emergency vehicle control unit that transmits a traffic light control mode cancellation request signal to the controlled traffic light and further comprises a manual control input module that receives and transfers a traffic light pass signal for manually controlling the traffic light, wherein the emergency vehicle control unit further comprises:

a controller module that receives the traffic light pass signal to generate a traffic light control cancellation signal;

a modulation module that modulates the control signal into a signal to be transmitted; and an RF module that frequency-up converts the modulated signal into a predetermined RF signal and transmits the converted signal.

2. The traffic light control apparatus of claim 1, further comprising a central control station that provides information of a specific emergency.

3. The traffic light control apparatus of claim 2, wherein the traffic light control unit comprises:

a signal reception unit that receives an emergency signal transmitted from the central control station through wireless/wired communication and a traffic light control mode cancellation request signal received from the emergency vehicle, and frequency-down convert and demodulate the signals;

a manual control input module that generates and outputs a control signal for manually controlling the traffic light; and a controller module that receives the converted and demodulated signals and the control signal to control the traffic light, outputs an emergency information signal acquired from the demodulated signals, receives the traffic light control mode cancellation request signal to complete the traffic light control, and stops transmitting the emergency information signal.

4. The traffic light control apparatus of claim 3, wherein the signal reception unit comprises:

a first radio frequency (RF) module that frequency-down converts the emergency signal received from the central control station through wireless/wired communication;

a first demodulation module that demodulates the converted signal;

a second RF module that frequency-down converts the traffic light control mode cancellation request signal received from the emergency vehicle; and a second demodulation module that demodulates the converted signal.

5. The traffic light control apparatus of claim 2, wherein the traffic light control unit comprises:

a signal reception unit that receives an emergency signal transmitted from the central control station through wireless/wired communication and a traffic light control mode cancellation request signal received from the emergency vehicle and frequency-down convert and demodulate the signals;

a manual control input module that generates and transmits a control signal for manually controlling the traffic light;

a controller module that receives the signals demodulated by the signal reception unit and the control signal to generate a signal informing entrance into the traffic light control mode and a control information signal containing a traffic light identifier (ID), completes the traffic light control, and stops transmitting an emergency information signal; and a signal transmission unit that modulates the signal informing the entrance into the traffic light control mode and the control information signal containing a traffic light ID, and frequency-up converts the modulated signals into RF signals.

6. The traffic light control apparatus of claim 5, wherein the signal reception unit comprises:

a first radio frequency (RF) module that frequency-down converts the emergency signal received from the central control station through wireless/wired communication;

a first demodulation module that demodulates the converted signal;

a second RF module that frequency-down converts the traffic light control mode cancellation request signal received from the emergency vehicle; and a second demodulation module that demodulates the converted signal.

7. The traffic light control apparatus of claim 5, wherein the signal transmission unit comprises:

a first modulation module that modulates the control information signal containing the traffic light ID;

a first RF module that receives the modulated signal, and frequency-up converts the modulated signal to transmit to the emergency vehicle;

a second modulation module that receives the signal informing the entrance into the traffic light control mode, and modulates the received signal; and a second RF module that receives the modulated signal, and frequency-up converts the received signal to transmit to the central control station.

8. The traffic light control apparatus of claim 5, wherein the signal transmission unit comprises:

a first modulation module that receives and modulates the traffic light control mode cancellation request signal;

a first RF module that receives the modulated signal, and frequency-up converts and transmits the received signal;

a second modulation module that modulates the traffic light control cancellation completion signal; and a second RF module that receives the modulated signal, and frequency-up converts and transmits the received signal.

9. The traffic light control apparatus of claim 2, wherein the manual control input module receives a manual input signal, and the emergency vehicle control unit comprises:

a signal reception unit that receives a transmitted signal of the central control station, a transmitted signal of the traffic light, and a global positioning system (GPS) signal;

and a signal transmission unit that modulates the traffic light control mode cancellation request signal and a traffic light control cancellation completion signal, and frequency-up converts the modulated signals, wherein the controller module receives the transmitted signal of the traffic light and the GPS signal and compares a current position of the emergency vehicle to determine whether the emergency vehicle passed the traffic light or generates the traffic light control mode cancellation request signal based on the manual input signal.

10. The traffic light control apparatus of claim 9, wherein the signal reception unit comprises:

a first RF module that receives the emergency signal transmitted from the central control station through wireless/wired communication, and frequency-down converts the received signal;

a first demodulation module that demodulates the converted signal;

a second RF module that receives the transmitted signal of the traffic light, and frequency-down converts the received signal;

a second demodulation module that demodulates the converted signal;

a third RF module that receives the GPS signal and frequency-down converts the received signal; and a third demodulation module that demodulates the converted signal.

11. A traffic light control method of a traffic light control unit for controlling a traffic light to pass an emergency vehicle in a traffic network, comprising:

setting the traffic light such that the emergency vehicle passes, when a first control signal for passing the emergency vehicle is received from a central control station;

maintaining the setting of the traffic light for a predetermined time after the traffic light is set;

manually controlling the traffic light through a manual control input module of the emergency vehicle;

controlling the traffic light through a predetermined scheme, when a manual cancellation signal is received from the emergency vehicle after the traffic light is set; and controlling the traffic light through a second predetermined scheme, when a predetermined time passes after the traffic light is set, and further comprising:

receiving a traffic light pass signal and generating a traffic light control cancellation signal;

modulating the traffic light control cancellation signal into a signal to be transmitted; and frequency-up converting the modulated signal into a predetermined RF signal and transmitting the converted signal.

12. A traffic light control method of an emergency vehicle to control a traffic light in a traffic network, comprising:

receiving a traffic light control signal and a traffic light identifier (ID) signal from a traffic light control unit;

determining whether the emergency vehicle passed the traffic light or not by using the traffic light control signal and the traffic light ID signal;

transmitting a manually initiated signal for cancelling a control mode; and transmitting emergency occurrence information to a central control station, the traffic light control method further comprising:

receiving a traffic light pass signal and generating a traffic light control cancellation signal;

modulating the traffic light control cancellation signal into a signal to be transmitted; and frequency-up converting the modulated signal into a predetermined RF signal and transmitting the converted signal.

* * * * *